US009431720B2

(12) United States Patent
Ito

(10) Patent No.: US 9,431,720 B2
(45) Date of Patent: Aug. 30, 2016

(54) CONNECTING STRUCTURE AND CONNECTING METHOD OF FLAT CIRCUIT BODY AND TERMINAL

(71) Applicant: YAZAKI CORPORATION, Tokyo (JP)

(72) Inventor: Naoki Ito, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/327,099

(22) Filed: Jul. 9, 2014

(65) Prior Publication Data

US 2014/0322993 A1 Oct. 30, 2014

Related U.S. Application Data

(63) Continuation of application No. PCT/JP2013/051361, filed on Jan. 17, 2013.

(30) Foreign Application Priority Data

Jan. 18, 2012 (JP) ..... 2012-008070

(51) Int. Cl.
*H01R 4/10* (2006.01)
*H01R 4/18* (2006.01)
(Continued)

(52) U.S. Cl.
CPC ..... *H01R 4/182* (2013.01); *H01R 12/69* (2013.01); *H01R 43/048* (2013.01)

(58) Field of Classification Search
CPC ..... H01R 4/185; H01R 4/20; H01R 4/188; H01R 43/058; H01R 43/16; H01R 4/2495; H01R 12/68; H01R 4/182; H05K 1/118; H05K 3/326
USPC ..... 439/877, 422
See application file for complete search history.

(56) References Cited

U.S. PATENT DOCUMENTS 3,239,918 A * 3/1966 Cobaugh ..... 29/867
3,715,457 A * 2/1973 Teagno et al. ..... 174/88 R
(Continued)

FOREIGN PATENT DOCUMENTS

DE 199 04 277 A1 8/1999
EP 0 926 764 A2 6/1999
(Continued)

OTHER PUBLICATIONS

International Search Report and Written Opinion of the International Search Report for PCT/JP2013/051361 dated Mar. 18, 2013.
(Continued)

*Primary Examiner* — Abdullah Riyami
*Assistant Examiner* — Vladimir Imas
(74) *Attorney, Agent, or Firm* — Kenealy Vaidya LLP

(57) ABSTRACT

A portion of a conductor of a flat circuit body is exposed from an insulating layer covering at least one of surfaces of the conductor. A terminal includes a bottom plate on which the exposed portion of the conductor is provided, and crimp claws which are raised at two side edges of the bottom plate so that the exposed portion of the conductor is disposed therebetween. A protective plate is provided on the exposed portion of the conductor, and has a strength so as not to be penetrated by the crimp claws when the crimp claws are crimped onto the protective member. The crimp claws are crimped onto the protective plate so that the terminal is crimped to the conductor in a state where the exposed portion of the conductor is in surface contact with the bottom plate.

3 Claims, 18 Drawing Sheets

(51) Int. Cl.
*H01R 12/69* (2011.01)
*H01R 43/048* (2006.01)

(56) References Cited

U.S. PATENT DOCUMENTS

| | | | | |
|---|---|---|---|---|
| 4,815,200 | A * | 3/1989 | Ito | 29/857 |
| 5,137,468 | A * | 8/1992 | Murakami | 439/422 |
| 5,316,506 | A * | 5/1994 | Ito | 439/879 |
| 6,068,505 | A | 5/2000 | Sai | |
| 6,077,131 | A * | 6/2000 | Fukuda et al. | 439/884 |
| 6,135,779 | A | 10/2000 | Koch et al. | |
| 6,375,492 | B1 | 4/2002 | Hio | |
| 6,394,836 | B2 * | 5/2002 | Nagai | 439/422 |
| 6,565,376 | B2 * | 5/2003 | Aoki | 439/422 |
| 7,462,062 | B2 * | 12/2008 | Kumakura | 439/422 |
| 7,509,732 | B2 * | 3/2009 | Kumakura | 29/753 |
| 7,901,257 | B2 * | 3/2011 | Okamura et al. | 439/877 |
| 8,636,390 | B2 * | 1/2014 | Middy | 362/457 |
| 2001/0016449 | A1 | 8/2001 | Aoki | |
| 2001/0023152 | A1 * | 9/2001 | Tachi et al. | 439/733.1 |
| 2001/0027052 | A1 | 10/2001 | Aoyama | |
| 2006/0166547 | A1 * | 7/2006 | Deutmarg et al. | 439/422 |
| 2006/0246768 | A1 * | 11/2006 | Kumakura | 439/422 |
| 2006/0264092 | A1 * | 11/2006 | Kumakura et al. | 439/422 |
| 2010/0035487 | A1 * | 2/2010 | Nakagawa et al. | 439/877 |
| 2010/0144217 | A1 * | 6/2010 | Kumakura et al. | 439/877 |
| 2012/0094551 | A1 * | 4/2012 | Corman et al. | 439/877 |
| 2014/0378011 | A1 * | 12/2014 | Aizawa et al. | 439/877 |

FOREIGN PATENT DOCUMENTS

| | | | |
|---|---|---|---|
| EP | 1 139 492 | A2 | 10/2001 |
| JP | 55-120080 | U | 8/1980 |
| JP | 61-93563 | A | 5/1986 |
| JP | 8-213142 | A | 8/1996 |
| JP | 11-195445 | A | 7/1999 |
| JP | 3064852 | B2 | 7/2000 |
| JP | 2001-135378 | A | 5/2001 |
| JP | 2004-221044 | A | 8/2004 |

OTHER PUBLICATIONS

Japanese Office Action for the related Japanese Patent Application No. 2012-008070 dated Jul. 7, 2015.

Japanese Office Action for the related Japanese Patent Application No. 2012-008070 dated Sep. 15, 2015.

Chinese Office Action for the related Chinese Patent Application No. 201380005856.1 dated Jan. 27, 2016.

Chinese Office Action for the related Chinese Patent Application No. 2013800058561 dated Oct. 26, 2015.

* cited by examiner

CONNECTING STRUCTURE AND CONNECTING METHOD OF FLAT CIRCUIT BODY AND TERMINAL

CROSS REFERENCE TO RELATED APPLICATIONS

This application is a continuation of PCT application No. PCT/JP2013/051361, which was filed on Jan. 17, 2013 based on Japanese Patent Application (No. 2012-008070) filed on Jan. 18, 2012, the contents of which are incorporated herein by reference.

BACKGROUND OF THE INVENTION

1. Field of the Invention

The present invention is related to a connecting structure and a connecting method of a flat circuit body and a terminal in which the terminal is crimped to connect to a conductor of the flat circuit body which is formed to a planar wiring member by at least covering the surfaces at one side of a plurality of conductors, which are separated at a predetermined interval and arranged into a planar shape, with insulating layers.

2. Description of the Related Art

A wiring member which has flexibility such as an FPC (Flexible Printed Circuit), an FFC (Flexible Flat Cable) or a ribbon electric wire corresponds to the flat circuit body.

FIGS. 17 and 18 show a conventional example of connecting structure of a flat circuit body and terminals.

The connecting structure of a flat circuit body and terminals is disclosed in the following patent document 1. In the connecting structure, as shown in FIG. 17, two overlapped terminal connecting parts 111 are formed by folding a middle part of the flat circuit body 110 beforehand.

A terminal 120 which connects to the flat circuit body 110 is a press formed article which is made of a metal plate, and includes a terminal fitting part 121 with which a mating terminal is fitted and connected, and a circuit body connecting part 122 to connect the flat circuit body 110, as shown in FIG. 17.

The circuit body connecting part 122 includes a bottom plate 122*a* on which the flat circuit body 110 is mounted, and crimp claws 122*b* which are raised at two side edges of the bottom plate 122*a*. The bottom plate 122*a* is formed into a belt shape whose width is narrower than a width w1 (refer to FIG. 18) of conductors 112 in the flat circuit body 110. The distal end of the crimp claw 122*b* is formed into a pointed shape so that the conductors 112 of the two overlapped terminal connecting parts 111 are penetrated therethrough.

In the connecting structure in PTL 1, after making the crimp claws 122*b* penetrate the conductor 112 of the terminal connecting parts 111 of the flat circuit body 110, by crimping the distal ends of the crimp claws 122*b* that project from the terminal connecting parts 111 to fold on the terminal connecting parts 111, a state that the terminals 120 are crimped to connect to the conductors 112 is reached.

CITATION LIST

Patent Literature

[PTL 1] JP-A-2004-221044

SUMMARY OF THE INVENTION

In the connecting structure in PTL 1, the crimp claws 122*b* penetrate through the conductors 112 of the flat circuit body 110 to electrically connect the conductors 112 and the terminals 120 with the contact in the penetrated parts. However, the conductors 112 of the flat circuit body 110 are damaged due to the penetration of the crimp claws 122*b*, and when a pulling load is applied on the flat circuit body 110, the damages expand, and electrical connection performance may decrease due to the increase of contact resistance with the expansion of the damages.

Further, in the crimping step of the crimp claws 122*b*, a jig (forming die) which bends the distal ends of the crimp claws 122*b* on the flat circuit body 110 is usually used. When the jig is a forming die to shape the crimp claws 122*b* to a curved form (curl form) so that the distal ends of the crimp claws 122*b* come in contact with the flat circuit body 110, in order to control a crimping pressure or precisely control the height of the crimp claws 122*b* after being shaped so that the distal ends of the crimp claws 122*b* will not excessively damage the conductors 112, force increasing or decreasing which is difficult in a crimping operation is required, and there is a problem that operativity is hard to be improved.

It is therefore one advantageous aspect of the present invention to provide a connecting structure and a connecting method of a flat circuit body and a terminal so that the electrical connection performance does not decrease because the conductors of the flat circuit body are damaged by a pulling load that is applied on the flat circuit body, and a stable electrical connection performance can be easily secured without requiring the force increasing or decreasing which is difficult in a crimping operation of the terminal.

According to one advantage of the invention, there is provided a connecting structure of a flat circuit body and a terminal, comprising:

a flat circuit body including a conductor and an insulating layer covering at least one of surfaces of the conductor, a portion of the conductor being exposed from the insulating layer;

a terminal including a bottom plate on which the exposed portion of the conductor is provided, and crimp claws which are raised at two side edges of the bottom plate so that the exposed portion of the conductor is disposed therebetween; and a protective plate, provided on the exposed portion of the conductor, and having a strength so as not to be penetrated by the crimp claws when the crimp claws are crimped onto the protective member, wherein the crimp claws are crimped onto the protective plate so that the terminal is crimped to the conductor in a state where the exposed portion of the conductor is in surface contact with the bottom plate, and distal ends of the crimp claws which press the protective plate are in a surface contact with the protective plate in a folded form.

The flat circuit body may include a plurality of conductors which are arranged in a planar shape with separated at a predetermined interval.

According to the present invention, the crimp claws of the terminal are crimped to the protective plate which is overlaid on the conductor exposed portion of the flat circuit body, and by pressing the protective plate to the side of the bottom plate of the terminal, to make the conductor in the conductor exposed portion to be in a surface contact with the bottom plate of the terminal, a crimped state of the conductor of the flat circuit body and the terminal is reached. That is, the crimp claws of the terminal will not penetrate through the conductor of the flat circuit body, and since the distal ends of the claws do not cut into the conductor, the crimp claws will not damage the conductor.

Therefore, even if a pulling load is acted on the flat circuit body, the damage will not expand in the conductor as traditionally, and there is no fear that electrical connection performance decreases due to the increase of contact resistance with the expansion of the damage in the conductor.

In addition, in the construction that the crimp claws press the conductor of the conductor exposed portion to the bottom plate of the terminal through the protective plate, since the crimp claws do not directly contact with the conductor exposed portion, the force increasing or decreasing which is difficult in a crimping operation of the terminal is not required. Therefore, the crimping operation can be performed easily.

Therefore, a stable electrical connection performance can be easily secured.

According to the invention, the electrical connection performance does not decrease when the conductor of the flat circuit body is damaged by a pulling load acted on the flat circuit body, and the force increasing or decreasing which is difficult in a crimping operation of the terminal is not required so that a stable electrical connection performance can be easily secured.

According to the invention, the sides of the distal ends of the crimp claws which press the protective plate are in a surface contact with the protective plate in a folded form. Because of the resilience (recovery power) possessed (accumulated) in the folded parts, when compared to the structure that the crimp claws simply abut with the protective plate in the form of one fold, the pressing force to the protective plate can be prevented from decreasing by a spring back of the crimp claws, and a stable electrical connection performance can be maintained for a longer term.

According to the crimp connecting structure and the crimp connecting method of the terminal and the flat circuit body of the present invention, the crimp claws of the terminal are crimped to the protective plate which is overlaid on the conductor exposed portion of the flat circuit body, and by pressing the protective plate to the side of the bottom plate of the terminal, to make the conductor in the conductor exposed portion to be in a surface contact with the bottom plate of the terminal, a crimped state of the conductor of the flat circuit body and the terminal is reached. That is, the crimp claws of the terminal will not penetrate through the conductor of the flat circuit body, and since the distal ends of the claws do not cut into the conductor, the crimp claws will not damage the conductor.

Therefore, even if a pulling load is applied on the flat circuit body, the damage will not expand in the conductor as traditionally, and there is no fear that electrical connection performance decreases due to the increase of contact resistance with the expansion of the damage in the conductor.

In addition, in the construction that the crimp claws press the conductor of the conductor exposed portion to the bottom plate of the terminal through the protective plate, since the crimp claws do not directly contact with the conductor exposed portion, the force increasing or decreasing which is difficult in a crimping operation of the terminal is not required. Therefore, the crimping operation can be performed easily.

Therefore, a stable electrical connection performance can be easily secured.

DETAILED DESCRIPTION OF THE EXEMPLARY EMBODIMENTS

Figure 1:
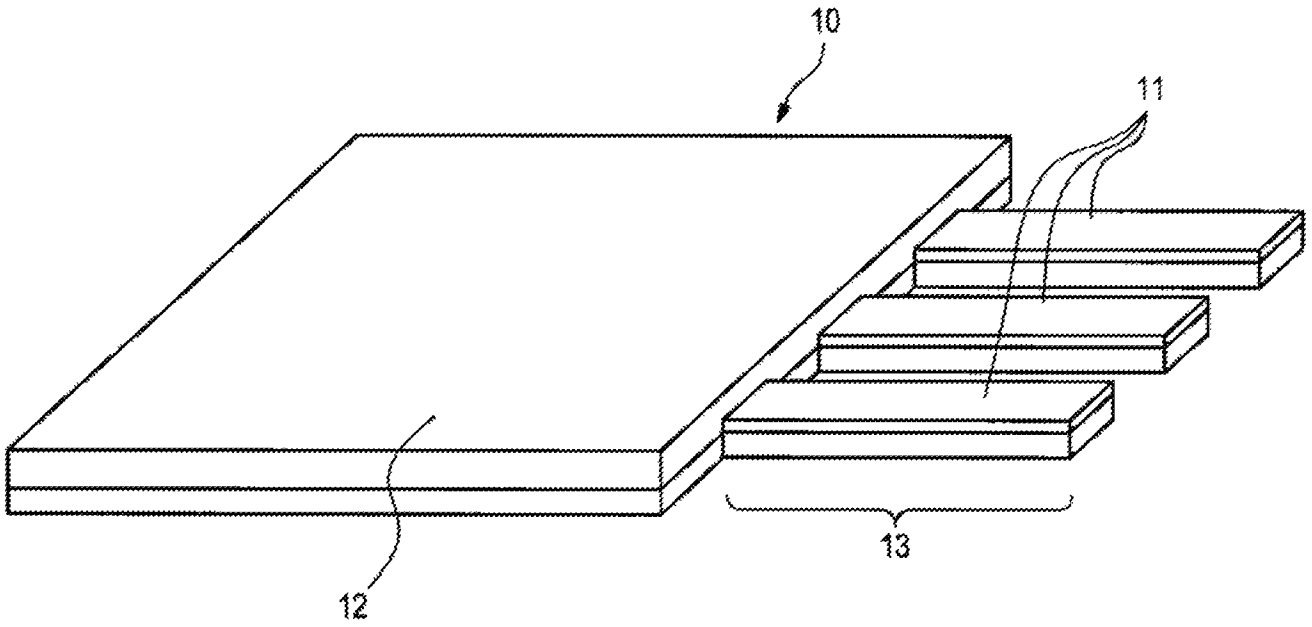
FIG. 1 is a perspective view which shows the structure of a conductor exposed portion of a flat circuit body used in a connecting structure of the flat circuit body and a terminal according to one embodiment of the present invention.
Figure 2:
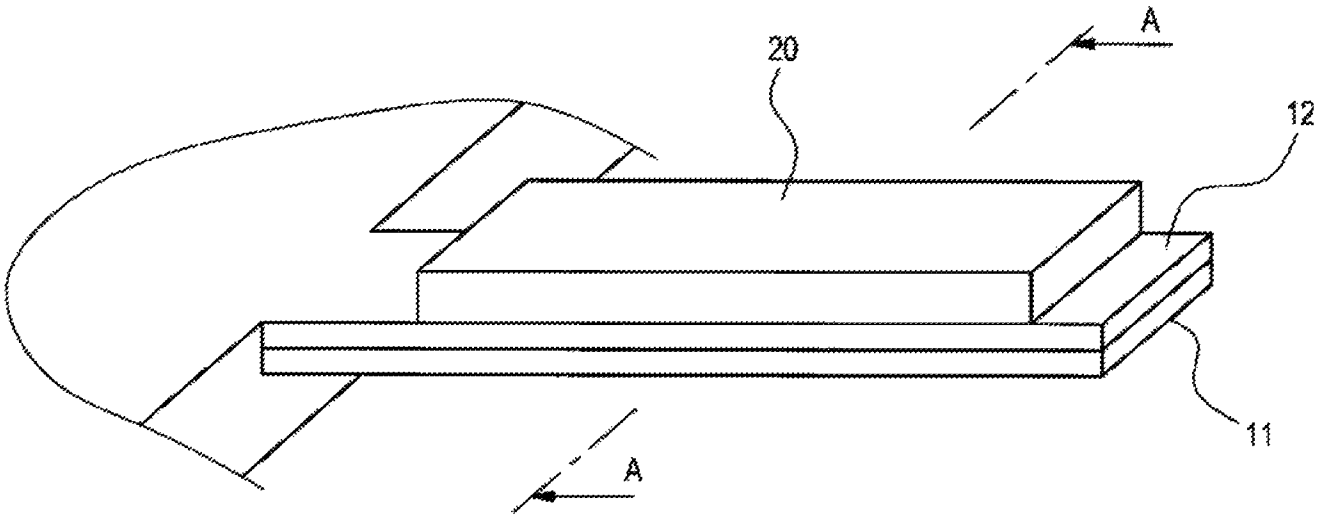
FIG. 2 is a perspective view which shows that a protective plate is mounted on the conductor exposed portion shown in FIG. 1.
Figure 3:
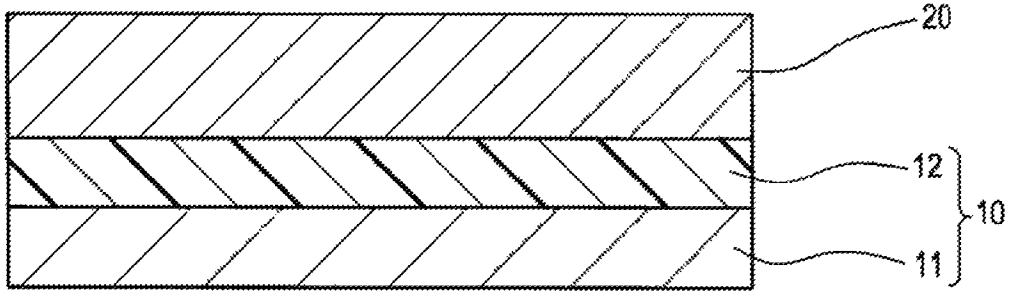
FIG. 3 is an A-A sectional view of FIG. 2.
Figure 4:
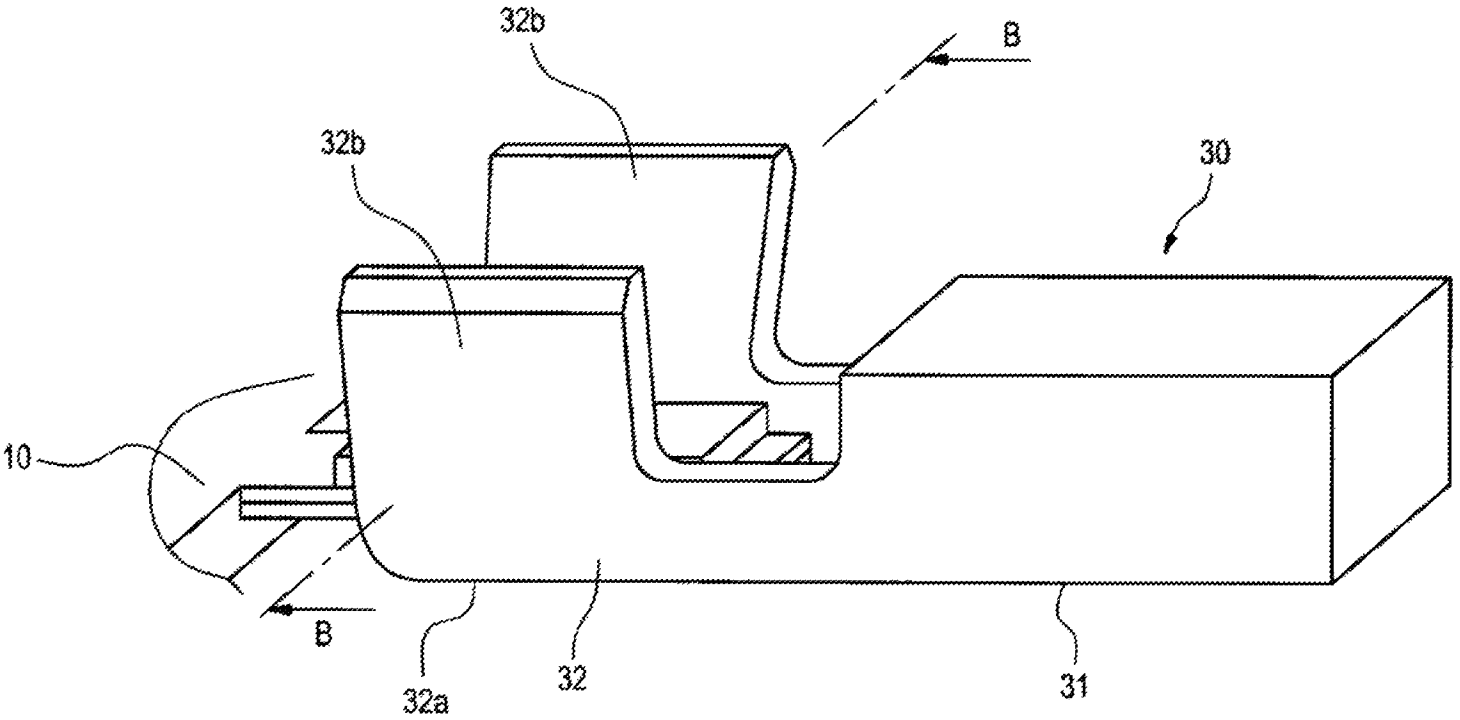
FIG. 4 is a perspective view which shows a state that the conductor exposed portion and the protective plate of FIG. 2 are mounted on a bottom plate of the terminal.
Figure 5:
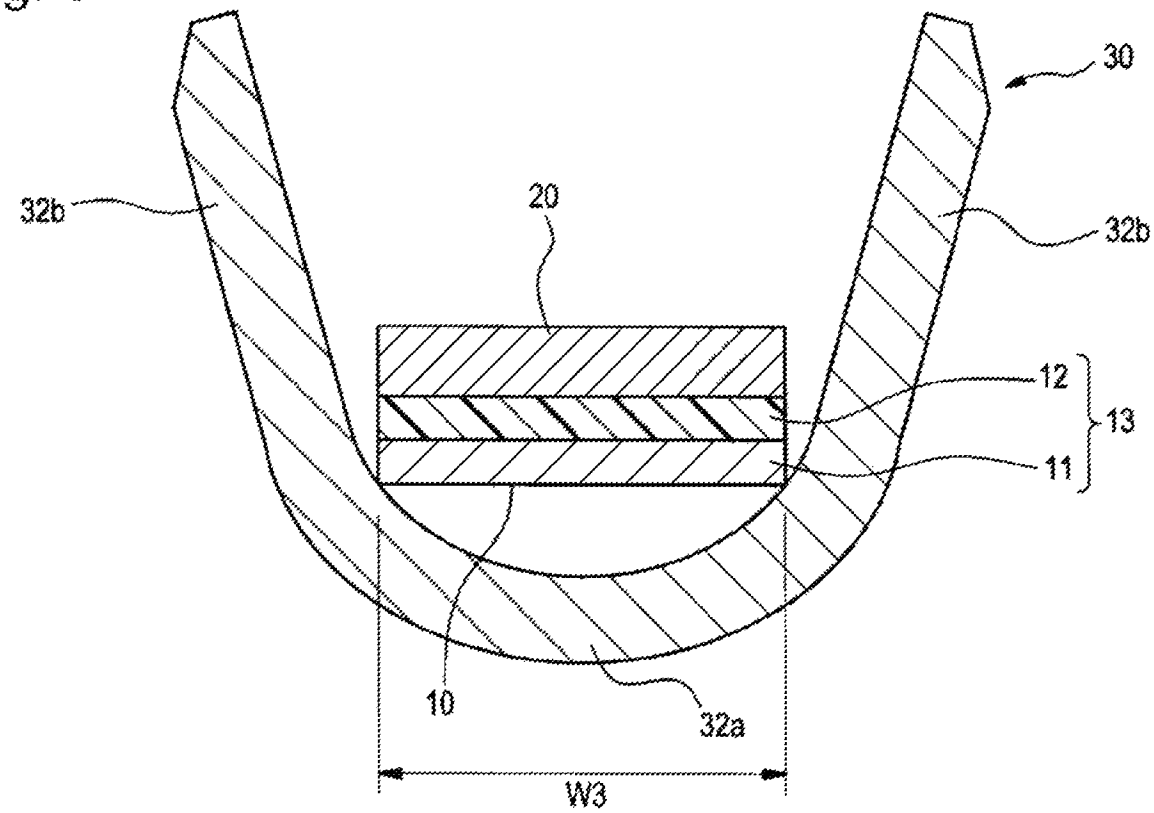
FIG. 5 is a B-B sectional view of FIG. 4.
Figure 6:
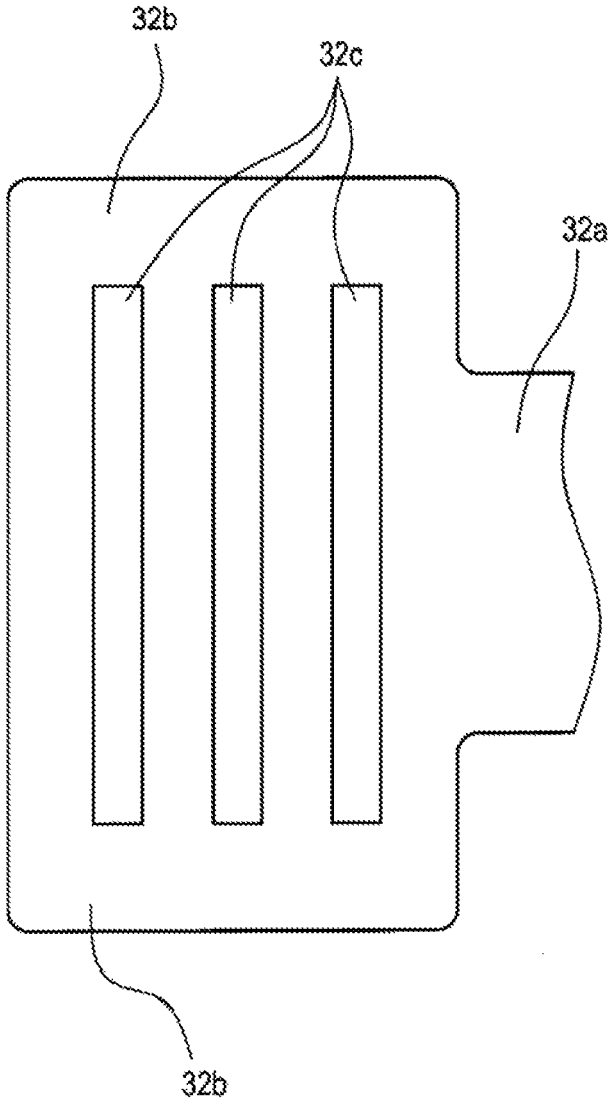
FIG. 6 is an illustrative figure of a structure of the end side of the bottom plate of crimp claws of the terminal shown in FIG. 5.
Figure 7:
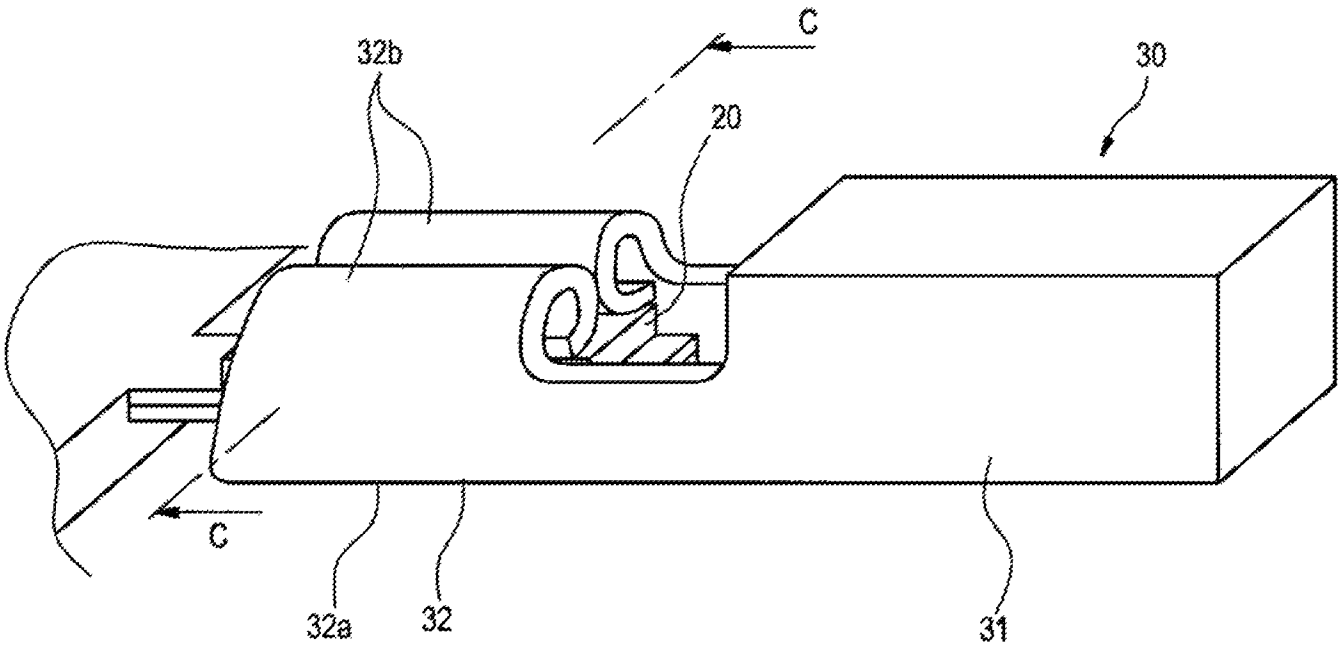
FIG. 7 is a perspective view which shows a completed connection state that the crimp claws are crimped on the protective plate from the state shown in FIG. 4.
Figure 8:
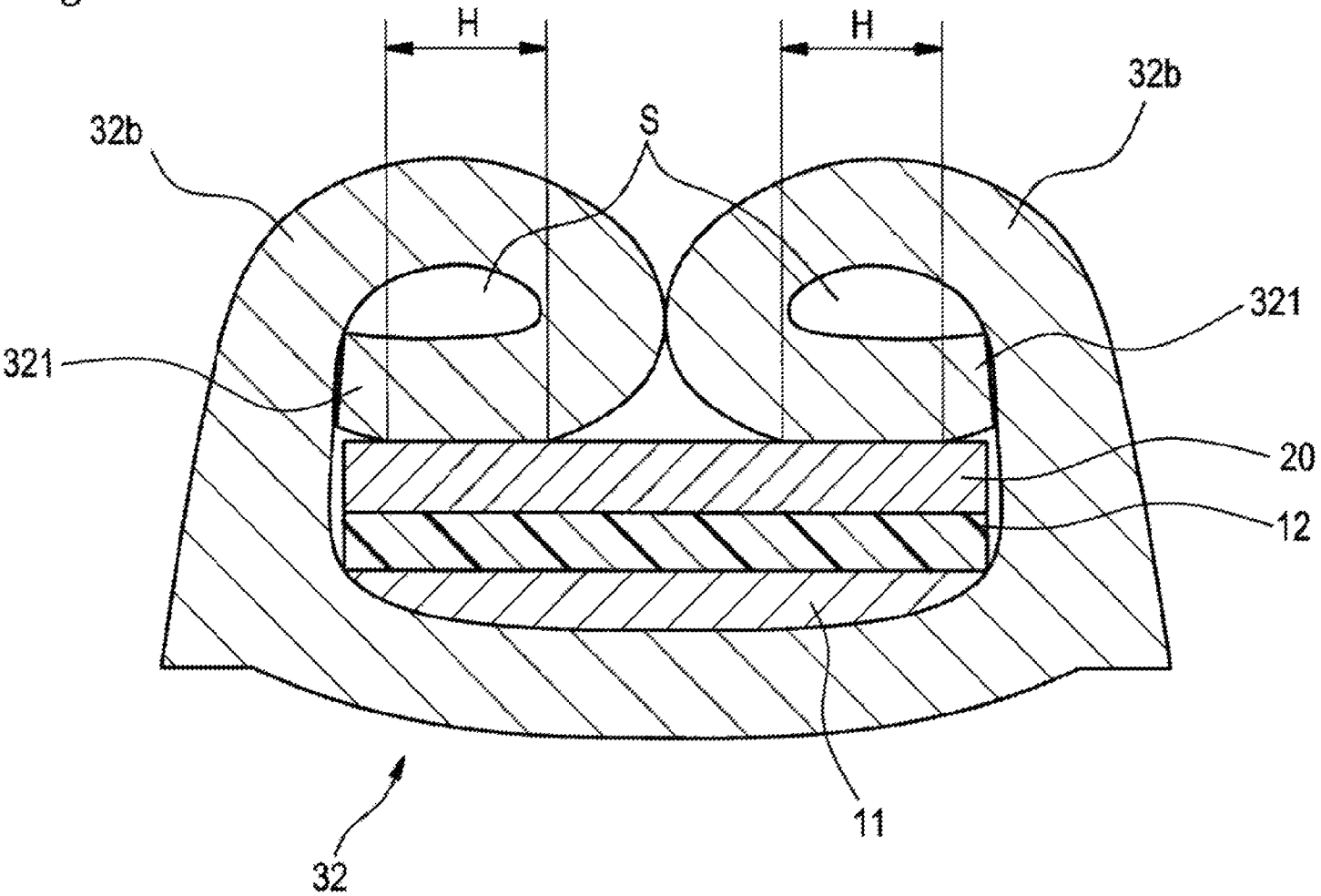
FIG. 8 is a C-C sectional view of FIG. 7.
Figure 9:
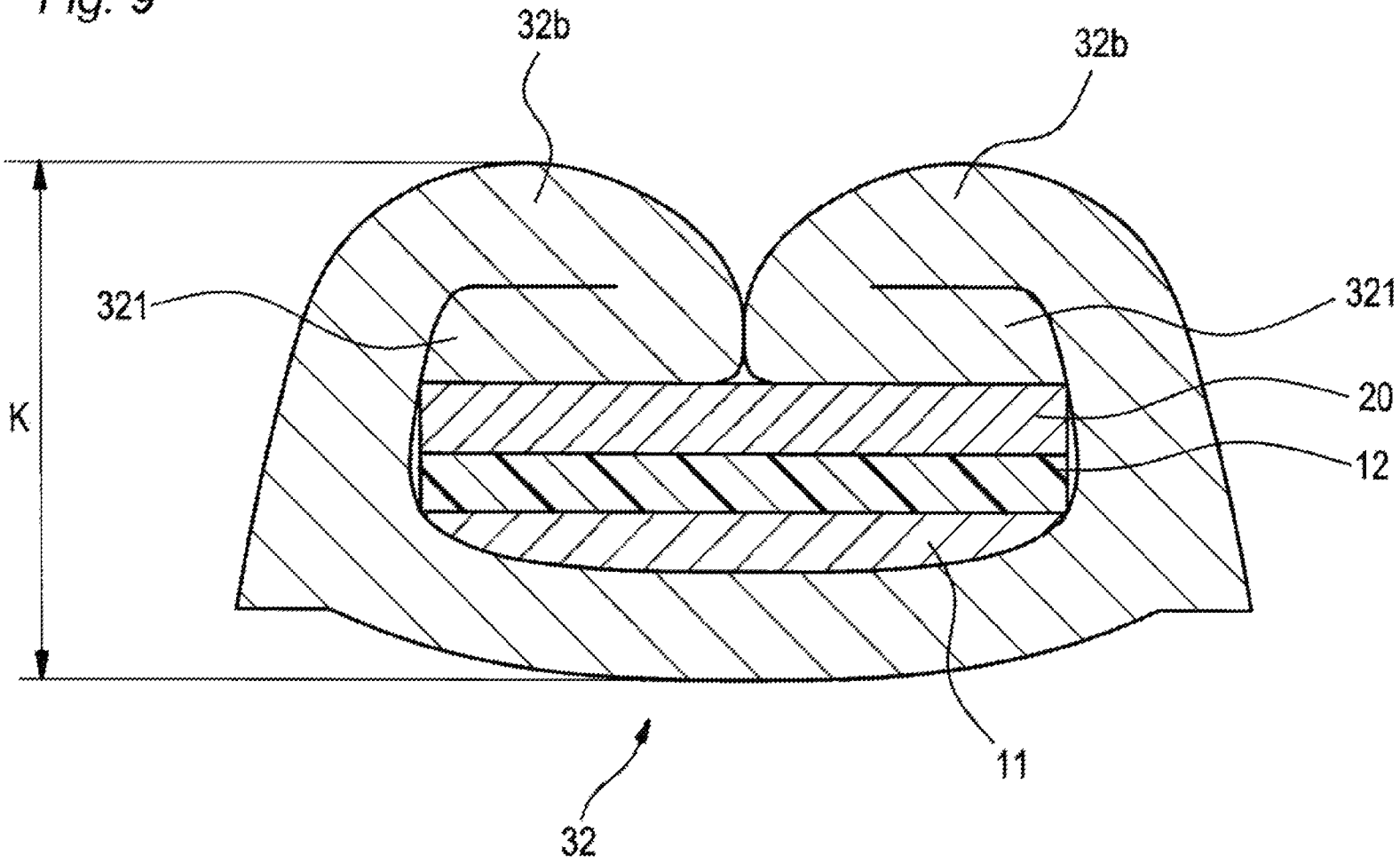
FIG. 9 is an illustrative figure which shows a state that the crimp claws are further crushed from the state of FIG. 8.

FIGS. 1 to 9 show an embodiment of connecting structure and connecting method of a flat circuit body and a terminal according to the present invention. FIG. 1 is a perspective view which shows the structure of a conductor exposed portion of the flat circuit body used in the embodiment of the present invention. FIG. 2 is a perspective view which shows that a protective plate is mounted on the conductor exposed portion shown in FIG. 1. FIG. 3 is an A-A sectional view of FIG. 2. FIG. 4 is a perspective view which shows a state that the conductor exposed portion and the protective plate of FIG. 2 are mounted on a bottom plate of the terminal. FIG. 5 is a B-B sectional view of FIG. 4. FIG. 6 is an illustrative figure of a structure of the end side of the bottom plate of crimp claws of the terminal shown in FIG. 5. FIG. 7 is a perspective view which shows a completed connection state that the crimp claws are crimped on the protective plate from the state shown in FIG. 4. FIG. 8 is a C-C sectional view of FIG. 7. FIG. 9 is an illustrative figure which shows a state that the crimp claws are further crushed from the state of FIG. 8.

FIG. 1 shows a flat circuit body 10 to which terminals are crimped to connect in a connecting structure of one embodiment of the present invention.

The flat circuit body 10 is manufactured to a planar wiring member by covering a plurality of conductors 11, which are separated at a predetermined interval and arranged into a planar shape, with insulating layers 12. In particular, a wiring member which has flexibility such as an FPC Flexible Printed Circuit), an FFC (Flexible Flat Cable) or a ribbon electric wire corresponds to the flat circuit body 10. The flat circuit body 10 corresponds to, for example, a flat circuit body in which surfaces at both sides of the conductors 11 are covered with insulating layers 12, and the conductors 11 are exposed by stripping a part of the insulating layers 12 of the surfaces at one side, a flat circuit body in which surfaces at one side of the conductors 11 are covered with insulating layers 12 and the other surfaces are exposed, or a flat circuit body in which surfaces at one side of the conductors 11 are covered with insulating layers 12, and a part of the surfaces at the other side are further covered with insulating layers 12.

In the present embodiment, a conductor exposed portion 13 shown in FIG. 1 is formed in the flat circuit body 10 beforehand. The conductor exposed portion 13 is a portion where the conductors 11 are exposed by stripping the insulating layers 12. In FIG. 1, the insulating layers 12 located between adjacent conductors 11 are removed and the insulating layers 12 covering the surfaces at one side of the conductors 11 are stripped so that the conductors 11 reach a state of exposing the surfaces at one side.

In this embodiment, a protective plate 20 shown in FIG. 2 is prepared. The protective plate 20 is a flat board-like member which has such a strength that the crimp claws of the terminal 30 to be described below will not pierce. It does not mind whether the material of the protective plate 20 is a conductive material or an insulating material. The protective plate 20 is a rectangular board having a width roughly the same as that of the conductors 11, and as shown in FIGS. 2 to 5, is placed to be overlaid on the conductor exposed portion 13 mounted on the terminal 30 to be described below.

The terminal 30 which is crimped to connect to the flat circuit body 10 is a press formed article that is made of a metal plate, and as shown in FIG. 4, includes a generally square pipe-like terminal fitting part 31 with which a mating terminal is fitted and connected, and a circuit body connecting part 32 to connect the flat circuit body 10.

The circuit body connecting part 32 includes a bottom plate 32*a* on which the flat circuit body 10 is mounted, and crimp claws 32*b* which are raised at two side edges of the bottom plate 32*a*. The bottom plate 32*a* is adapted to be able to carry the conductor 11 of a width w3 (refer to FIG. 5) in the flat circuit body 10. On the surface of the bottom plate 32*a* on which the conductor exposed portion 13 is mounted, as shown in FIG. 6, groove-like serrations 32*c* are formed.

Each of the crimp claws 32*b* which extend from two side edges of the bottom plate 32*a* is a part that is crimped to the conductor exposed portion 13 which is mounted on the bottom plate 32*a*. In a crimping step of crimping and shaping the crimp claws 32*b*, a crimp jig (forming die) that makes the crimp claws 32*b* to be curved from the distal end side of the crimp claws 32*b* to make the distal ends 321 of the crimp claws 32*b* come in contact with the surface of the protective plate 20 is used, although the crimp jig is not shown in the figures.

For the connecting structure of the flat circuit body and the terminal in the present embodiment, first, as shown in FIGS. 4 and 5, the protective plate 20 is mounted on the conductor exposed portion 13 which is mounted on the bottom plate 32*a* in a direction that the conductor 11 exposed in the conductor exposed portion 13 meets the bottom plate 32*a*, and by crimping the crimp claws 32*b* from above the protective plate 20 to make the conductor 11 closely contact with the bottom plate 32*a* in a surface contact state through the protective plate 20, as shown in FIGS. 7 and 8, a crimped state of the conductor 11 and the terminal 30 is reached.

Further, for the connecting structure of the present embodiment, when the crimp claws 32*b* are crimped and shaped, as shown in FIG. 8, the distal ends 321 of the crimp claws 32*b* are bended to the base ends of the crimp claws so that the crimp claws are shaped into such a bended shape that those part in predetermined length ranges H (refer to FIG. 8) from the distal ends 321 are folded and in a surface contact with the protective plate 20.

A connecting method to obtain the connecting structure of the present embodiment sequentially performs a conductor exposed portion forming step, a circuit body mounting step and a crimping step shown as follows.

The conductor exposed portion forming step is a step of forming the conductor exposed portion 13 in the flat circuit body 10 which is manufactured to a planar wiring member by covering a plurality of conductors 11, which are separated at a predetermined interval and arranged into a planar shape, with the insulating layers 12, by stripping the insulating layers 12 to expose the conductors 11, as shown in FIG. 1. When a flat circuit body 10 in which a part of the conductors 11 are exposed beforehand is used, the conductor exposed portion forming step is omitted.

The circuit body mounting step is a step of mounting the conductor exposed portion 13 on the bottom plate 32*a* in a direction that the conductor 11 exposed in the conductor exposed portion 13 meets the bottom plate 32*a* of the terminal 30, as shown in FIGS. 4 and 5.

The crimping step is a step of crimping the crimp claws 32*b* at two side edges of the bottom plate 32*a* onto the protective plate 20 in a state that the above-mentioned protective plate 20 is overlaid on the conductor exposed portion 13 mounted on the bottom plate 32*a*, to press the protective plate 20 to the side of the bottom plate 32*a* to make the conductor 11 closely contact with the bottom plate 32*a* in a surface contact state through the protective plate 20 so that the conductor 11 and the bottom plate 32*a* are in a crimped connection state.

In the crimping step, as a means for crimping the crimp claws 32*b* to the protective plate 20, a crimp jig which makes the crimp claws 32*b* to be curved from the distal ends to come in contact with the protective plate 20 is used.

Further, in the crimping step, as shown in FIG. 8, the distal ends 321 of the crimp claws 32*b* are bended to the base ends of the crimp claws 32*b* so that the crimp claws are shaped into such a bended shape that those part in the predetermined length ranges H from the distal ends 321 are folded and in a surface contact with the protective plate 20.

In the present embodiment, when cavities S remain inside the crimp claws 32*b* which are in a surface contact with the protective plate 20 as shown in FIG. 8, the crimp claws 32*b* are further crushed by the crimp jig to get a structure that there is no cavity S as shown in FIG. 9, so that the height K of the crimped parts is further lowered, and downsizing becomes possible.

For the connecting structure of the flat circuit body and the terminal of the embodiment described above, the crimp claws 32*b* of the terminal 30 are crimped to the protective plate 20 which is overlaid on the conductor exposed portion 13 of the flat circuit body 10, and by pressing the protective plate 20 to the side of the bottom plate 32*a* of the terminal 30, to make the conductor 11 in the conductor exposed portion 13 closely contact with the bottom plate 32*a* of the terminal 30 in a surface contact state, a crimped state of the conductor 11 of the flat circuit body 10 and the terminal 30 is reached. That is, the crimp claws 32*b* of the terminal 30 will not penetrate through the conductor 11 of the flat circuit body 10, and since the distal ends of the claws do not cut into the conductor 11, the crimp claws 32*b* will not damage the conductor 11.

Therefore, even if a pulling load is applied on the flat circuit body 10, the damage will not expand in the conductor 11 as traditionally, and there is no fear that electrical connection performance decreases due to the increase of contact resistance with the expansion of the damage in the conductor 11.

In addition, in the construction that the crimp claws 32*b* press the conductor 11 of the conductor exposed portion 13 to the bottom plate 32*a* of the terminal 30 through the protective plate 20, since the crimp claws 32*b* do not directly contact with the conductor exposed portion 13, the force increasing or decreasing which is difficult in a crimping operation of the terminal 30 is not required. Therefore, the crimping operation can be performed easily.

Therefore, a stable electrical connection performance can be easily secured.

Further, by performing the previous steps in the connecting method, the connecting structure of the present embodiment can be formed. Therefore, there is no fear that the electrical connection performance decreases when the conductor 11 of the flat circuit body 10 is damage by a pulling load applied on the flat circuit body 10, and the force increasing or decreasing which is difficult in a crimping operation of the terminal 30 is not required so that a stable electrical connection performance can be easily secured.

In the connecting structure and the connecting method in the present embodiment, the sides of the distal ends 321 of the crimp claws 32*b* which press the protective plate 20 are in a surface contact with the protective plate 20 in a folded form as shown in FIGS. 8 and 9. Because of the resilience (recovery power) possessed (accumulated) in the folded parts, when compared to the structure that the crimp claws simply come in contact with the protective plate 20 in the form of one fold, the pressing force to the protective plate 20 can be prevented from decreasing by a spring back of the crimp claws 32*b*, and a stable electrical connection performance can be maintained for a longer term.

In the connecting structures and the connecting methods of the present invention, the specific structure of the conductor exposed portion 13 formed in the flat circuit body 10 is not limited to the structure of FIG. 1.

Figure 10:
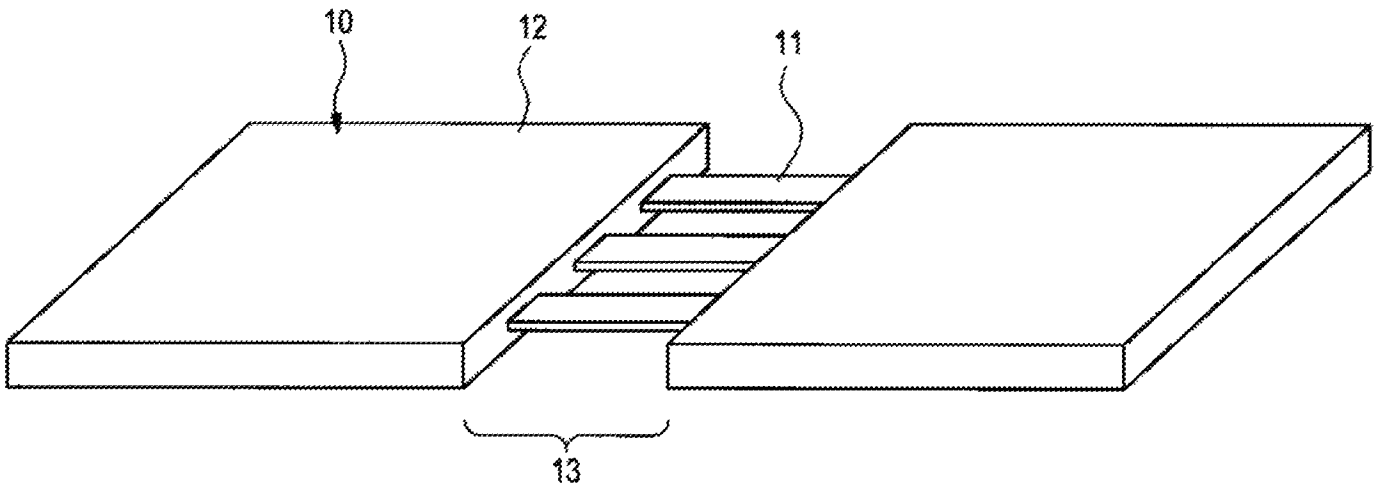
FIG. 10 is a perspective view which shows another embodiment of conductor exposed portion in the flat circuit body according to the present invention.

FIG. 10 shows another embodiment of conductor exposed portion 13 to which the terminal 30 shown in FIG. 4 is crimped to connect. In this embodiment, the conductor exposed portion 13 is not at an end of the flat circuit body 10, but is formed at a middle part of the flat circuit body 10. Further, insulating layers 12 on the front and back surfaces of the conductors 11 are stripped.

Figure 11:
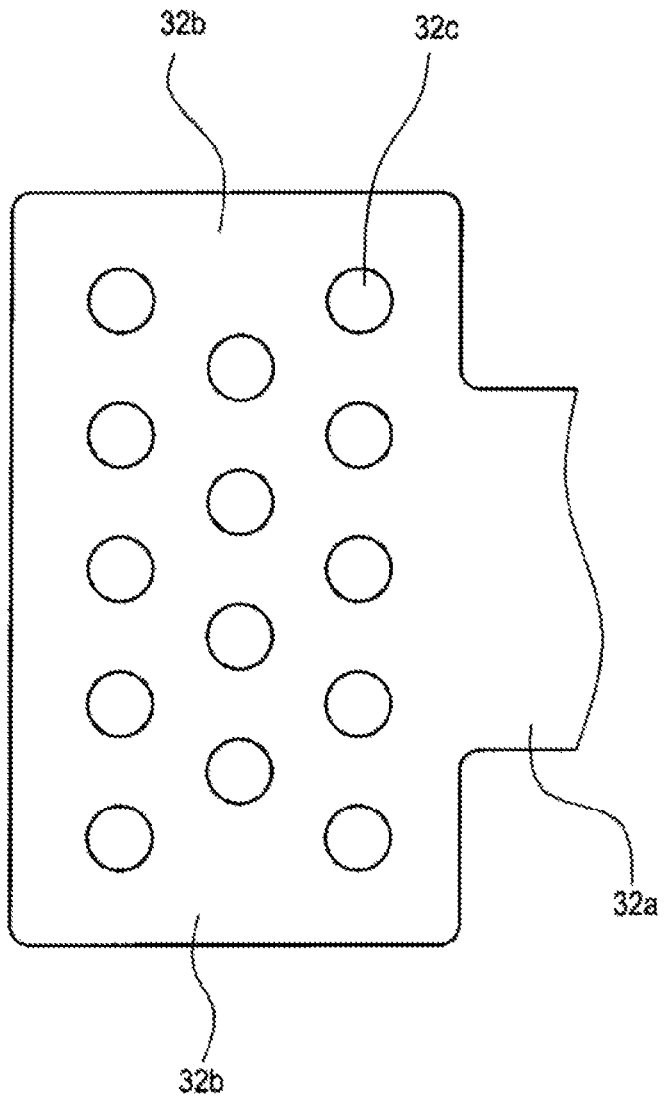
FIG. 11 is a figure which shows bottom plate and crimp claws of the terminal according to the present invention, and is an expanded view of the embodiment in which the shape of serrations is changed.
Figure 12:
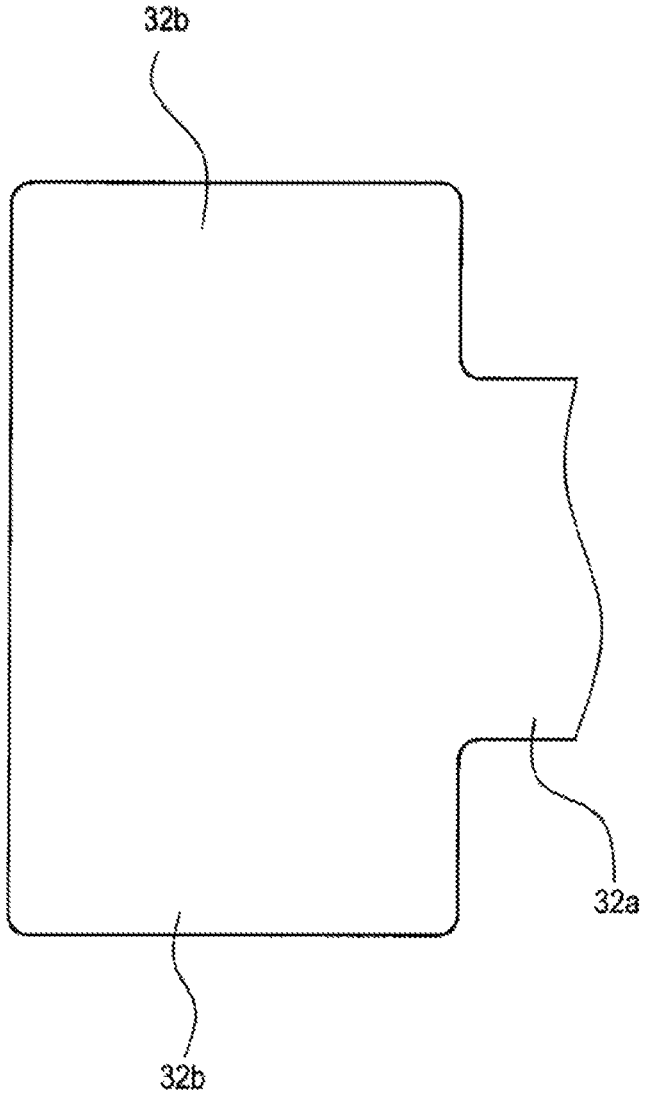
FIG. 12 is a figure which shows another embodiment of bottom plate and crimp claws of the terminal according to the present invention, and is an expanded view of the embodiment in which the serrations are omitted and replaced with a simple flat smooth surface.

In the connecting structures and the connecting methods of the present invention, the shape of the serrations which are formed on the inner surface of the bottom plate 32*a* and the crimp claws 32*b* in the circuit body connecting part 32 of the terminal 30 is not limited to that shown in FIG. 6. The serrations 32*c* that are formed on the inner surface of the bottom plate 32*a* and the crimp claws 32*b* may be circular recesses as shown in FIG. 11. As shown in FIG. 12, the inner surface of the bottom plate 32*a* and the crimp claws 32*b* may be a flat smooth surface on which the serrations are not formed.

Figure 13:
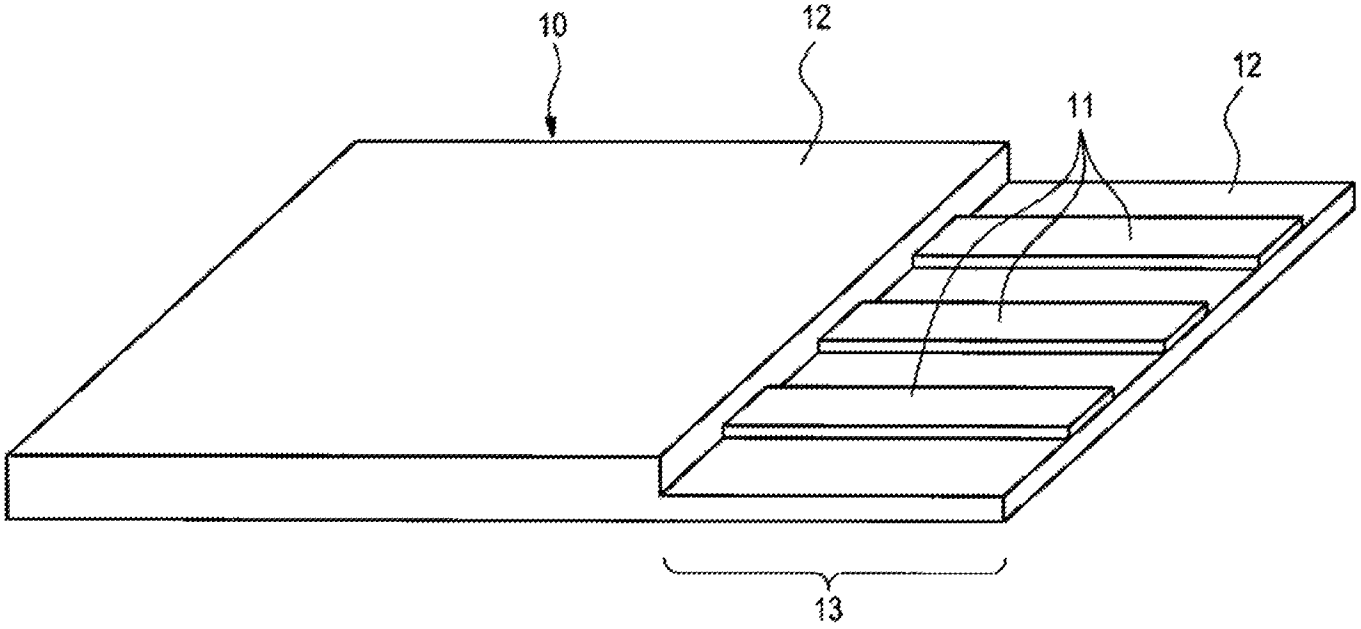
FIG. 13 is a perspective view which shows another embodiment of conductor exposed portion of the flat circuit body according to the present invention.
Figure 14:
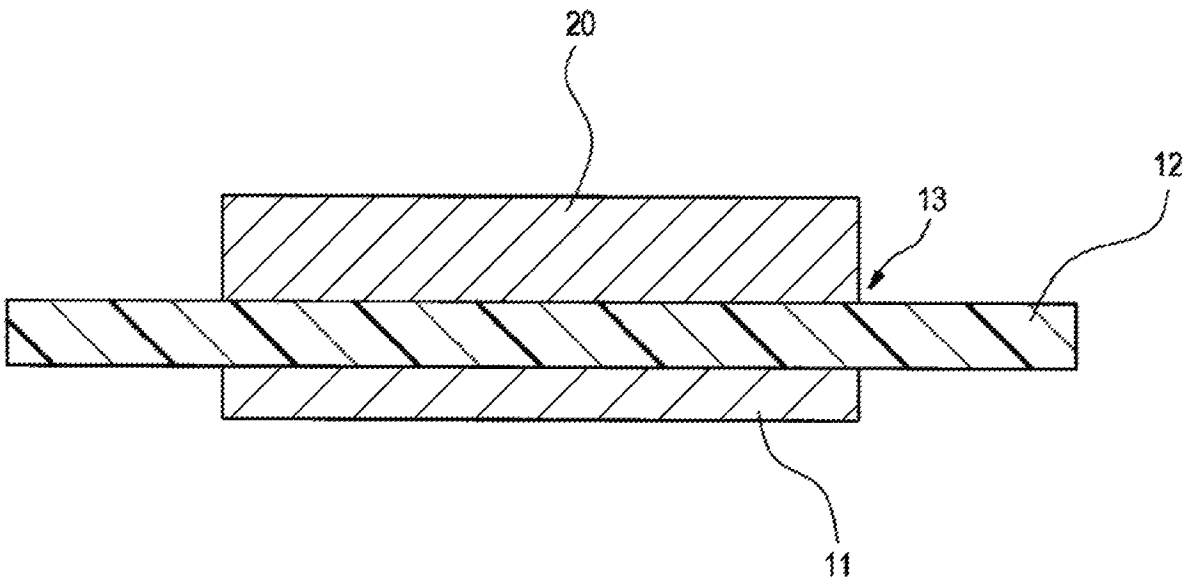
FIG. 14 is a cross sectional view of the conductor exposed portion in a state that a protective plate is mounted on an insulating layer of the conductor exposed portion shown in FIG. 13.
Figure 15:
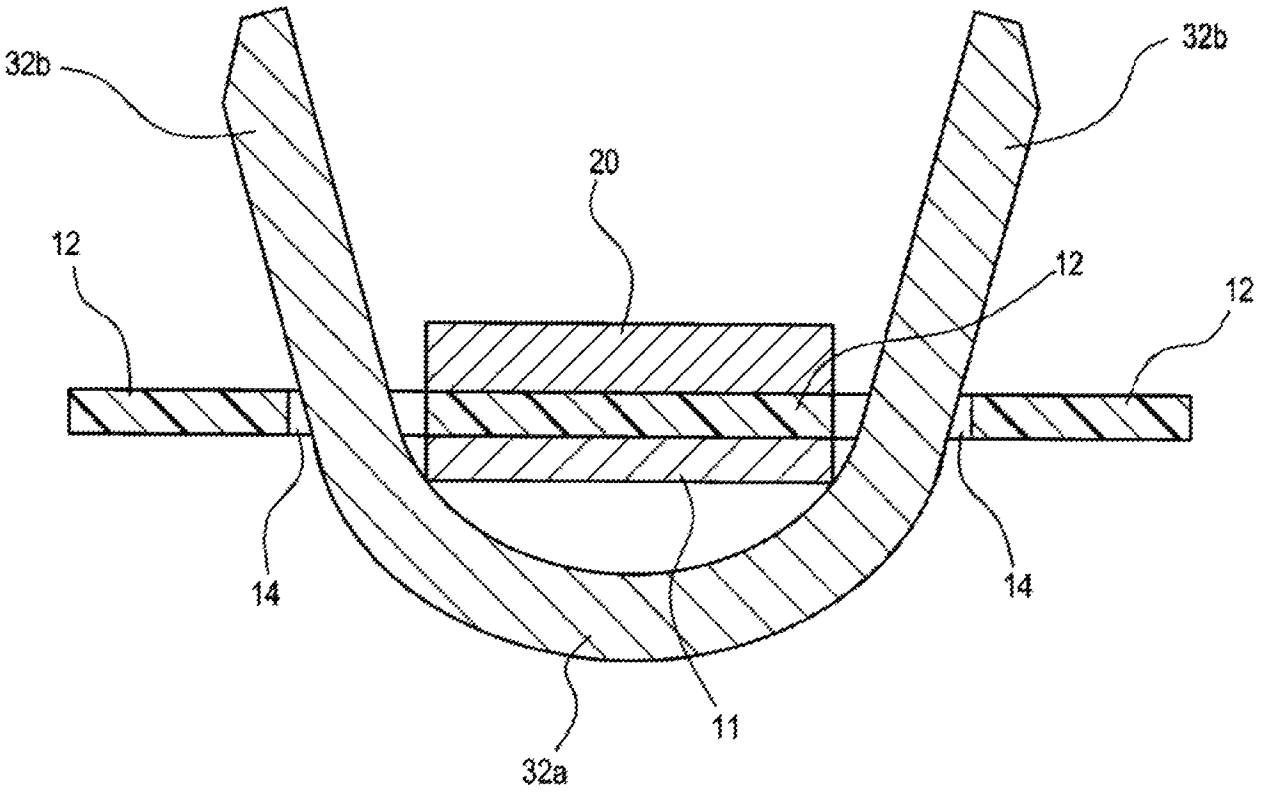
FIG. 15 is a cross sectional view which shows a state that the conductor exposed portion shown in FIG. 14 is mounted on the bottom plate of an end of the terminal.
Figure 16:
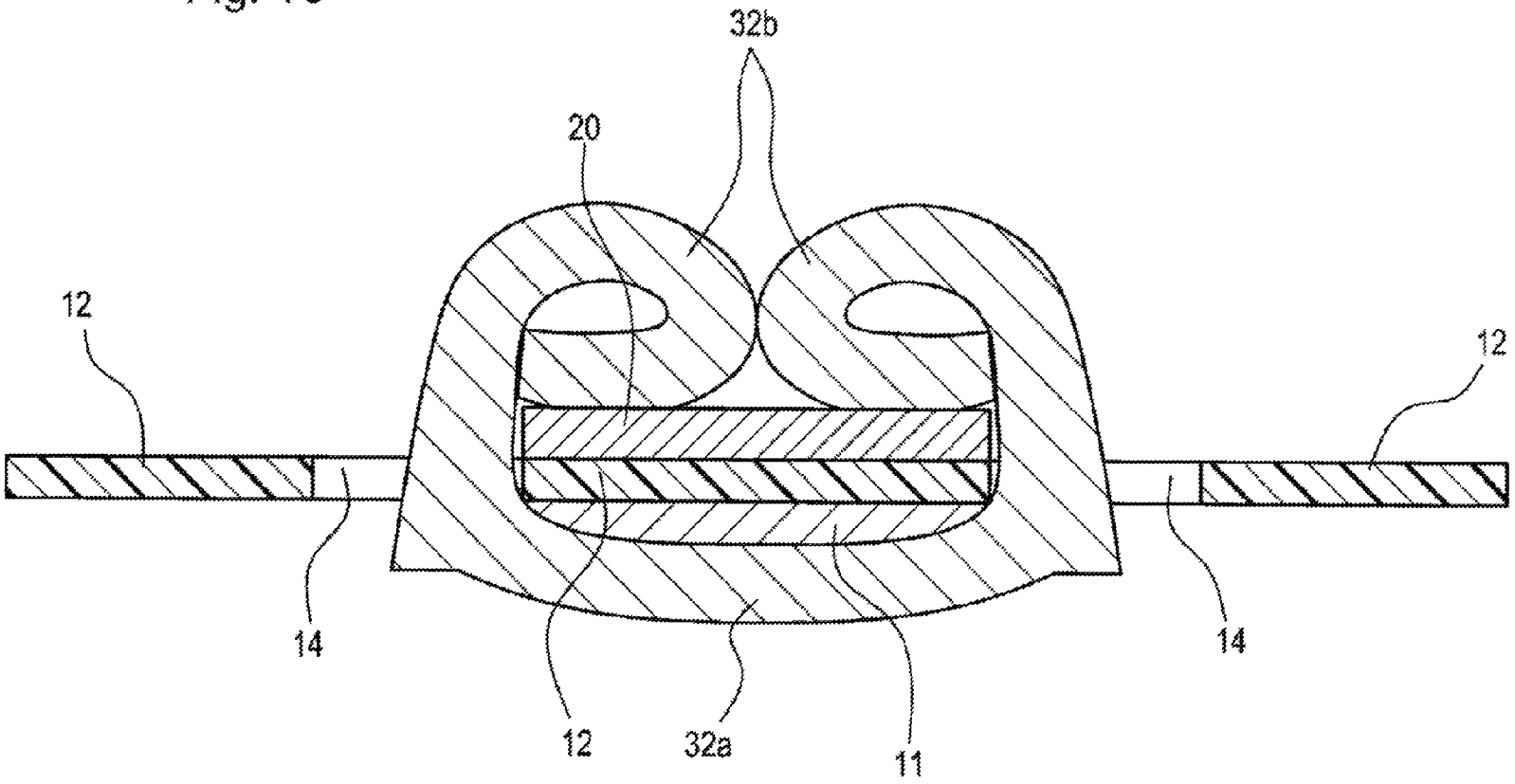
FIG. 16 is a cross sectional view of the end of the terminal in a state that the crimp claws are crimped to the conductor exposed portion shown in FIG. 15.
Figure 17:
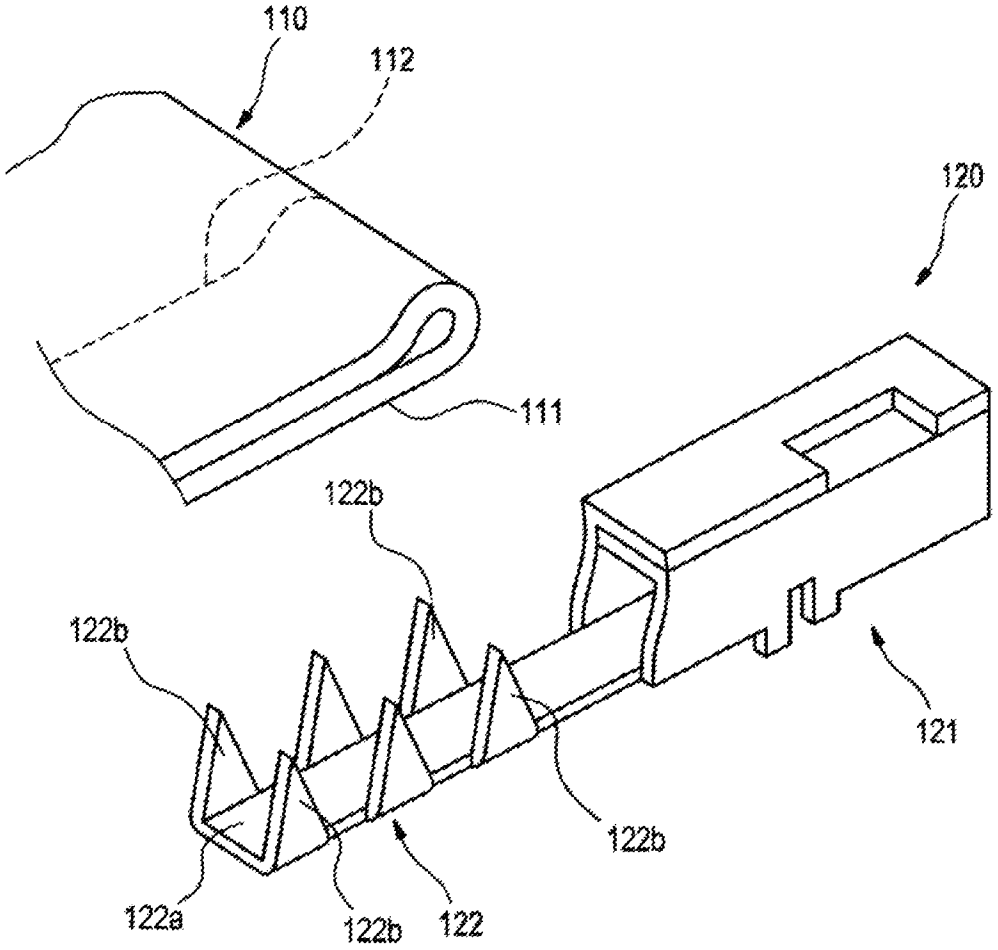
FIG. 17 is an exploded perspective view of a traditional connecting structure of a flat circuit body and a terminal.
Figure 18:
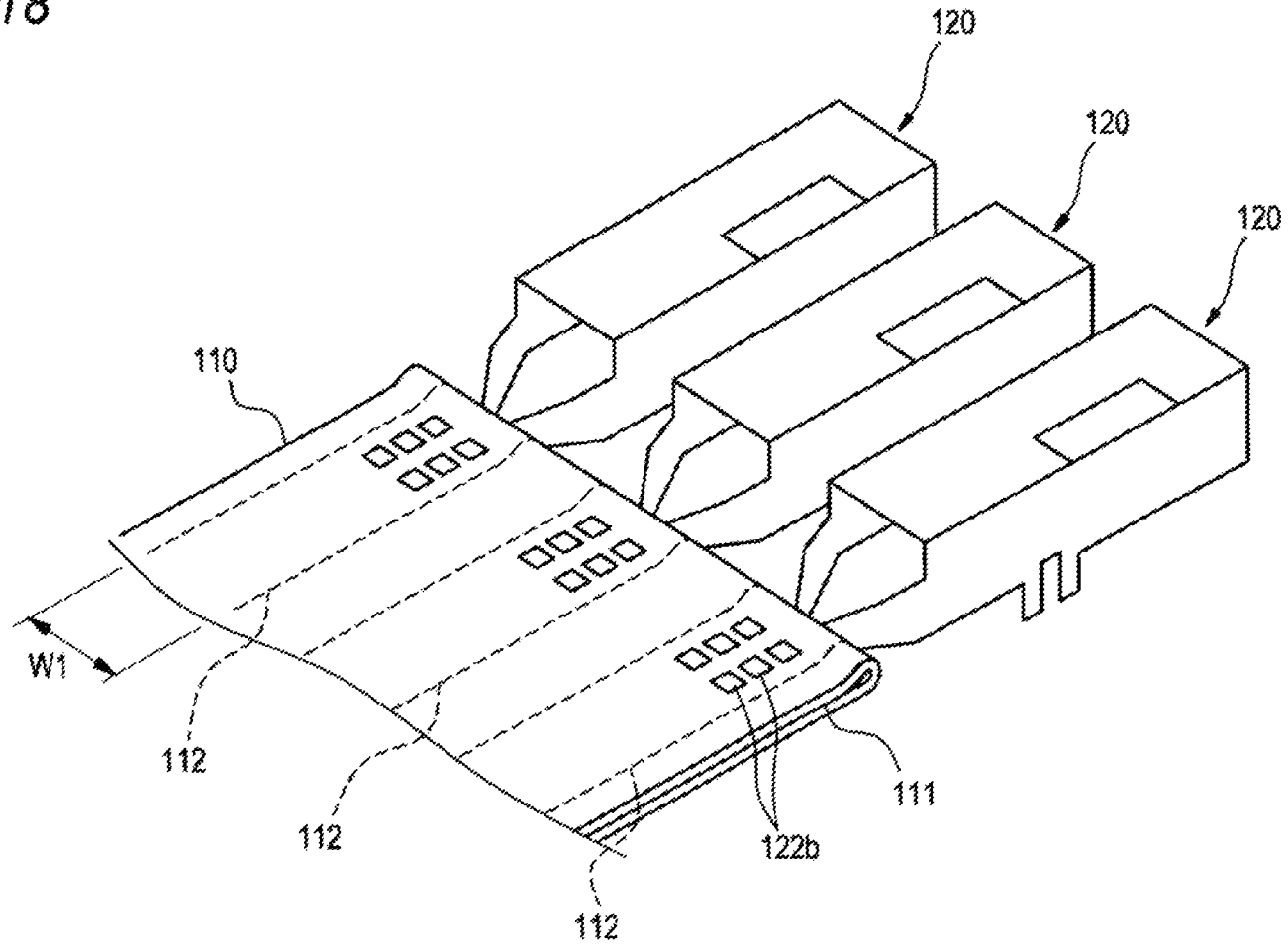
FIG. 18 is a perspective view which shows a state after the connection of the flat circuit body and the terminal shown in FIG. 17 is completed.

In the connecting structures and the connecting methods of the present invention, the conductor exposed portion 13 formed in the flat circuit body 10 may have such a construction that when only the insulating layers 12 of the surfaces at one side of the conductors 11 are stripped and the insulating layers 12 of the surfaces at the other side remain, the insulating layers 12 between adjacent conductors 11 are left, as shown in FIGS. 13 and 14. In this case, as shown in FIGS. 15 and 16, by providing claw through holes 14 into which the crimp claws 32*b* are inserted in the insulating layers 12 between adjacent conductors 11 beforehand, the conductor exposed portion 13 can be easily mounted onto the circuit body connecting part 32.

In the above-mentioned embodiments, the protective plate 20 is a separate member from the terminal 30, but the terminal 30 may be integrally equipped with the protective plate 20.

According to the present invention, there is provided a connecting structure and a connecting method of a flat circuit body and a terminal so that the electrical connection performance does not decrease because the conductors of the flat circuit body are damaged by a pulling load that is applied on the flat circuit body, and a stable electrical connection performance can be easily secured without requiring the force increasing or decreasing which is difficult in a crimping operation of the terminal.

What is claimed is:

1. A connecting structure of a flat circuit body and a terminal, comprising:

a flat circuit body including a conductor and an insulating layer covering at least one of surfaces of the conductor, a portion of the conductor being exposed from the insulating layer;

a terminal including a bottom plate on which the exposed portion of the conductor is provided, and crimp claws which are raised at two side edges of the bottom plate so that the exposed portion of the conductor is disposed therebetween; and a planar protective plate, being a separated member from the terminal, provided on the exposed portion of the conductor, and having a strength so as not to be penetrated by the crimp claws when the crimp claws are crimped onto the protective member, wherein the crimp claws are crimped onto the protective plate so that the terminal is crimped to the conductor in a state where the exposed portion of the conductor is in surface contact with the bottom plate, and distal ends of the crimp claws which press the protective plate are in a surface contact with the protective plate in a folded form.

2. The connecting structure according to claim 1, wherein the flat circuit body includes a plurality of conductors which are arranged in a planar shape with separated at a predetermined interval.

3. The connecting structure according to claim 1, wherein the distal end of each crimp claw tightly abuts another portion of the respective crimp claw.

* * * * *